United States Patent [19]

Dreps et al.

[11] Patent Number: 4,516,697

[45] Date of Patent: May 14, 1985

[54] LIQUID PRODUCT DISPENSER

[75] Inventors: James R. Dreps, Kinnelon; Edward J. Drozd, Lake Hiawatha, both of N.J.

[73] Assignee: Captive Plastics Inc., Piscataway, N.J.

[21] Appl. No.: 421,545

[22] Filed: Sep. 22, 1982

[51] Int. Cl.[3] ..... B65D 37/00

[52] U.S. Cl. ..... 222/212; 222/207; 222/185; 222/519; 222/548

[58] Field of Search ..... 222/206, 207, 209, 212, 222/215, 184, 185, 519, 548, 549, 553

[56] References Cited

U.S. PATENT DOCUMENTS

| | | | |
|---|---|---|---|
| 762,299 | 6/1904 | Fulton | 222/206 |
| 3,154,222 | 10/1964 | Heckman | 222/215 |
| 3,261,513 | 7/1966 | Moran | 222/519 |
| 3,606,105 | 9/1971 | Santore | 222/549 X |
| 4,324,349 | 4/1982 | Kaufman | 222/185 X |

*Primary Examiner*—Joseph J. Rolla

*Assistant Examiner*—Nils E. Pedersen

*Attorney, Agent, or Firm*—Paul J. Sutton

[57] ABSTRACT

The present invention provides a hand dispenser for a liquid product that includes a resilient closed container mounted upon a base. The container, which has a discharge port connected to a dispensing orifice for the liquid product, is movable between a first position, which closes the discharge port and makes the dispenser adapted for traveling, shipment, and the like. The container also has a second position, which opens the discharge port and places the dispenser in the dispensing mode. The dispenser, when in the dispensing mode, is manually operated by squeezing the container, which dispenses a portion of the liquid product; upon return of the resilient container to its original shape, the level of the liquid drops, and a lesser pressure is created in the air pocket over the liquid product, thus causing atmospheric air to press back any movement of liquid product toward the dispensing orifice.

8 Claims, 6 Drawing Figures

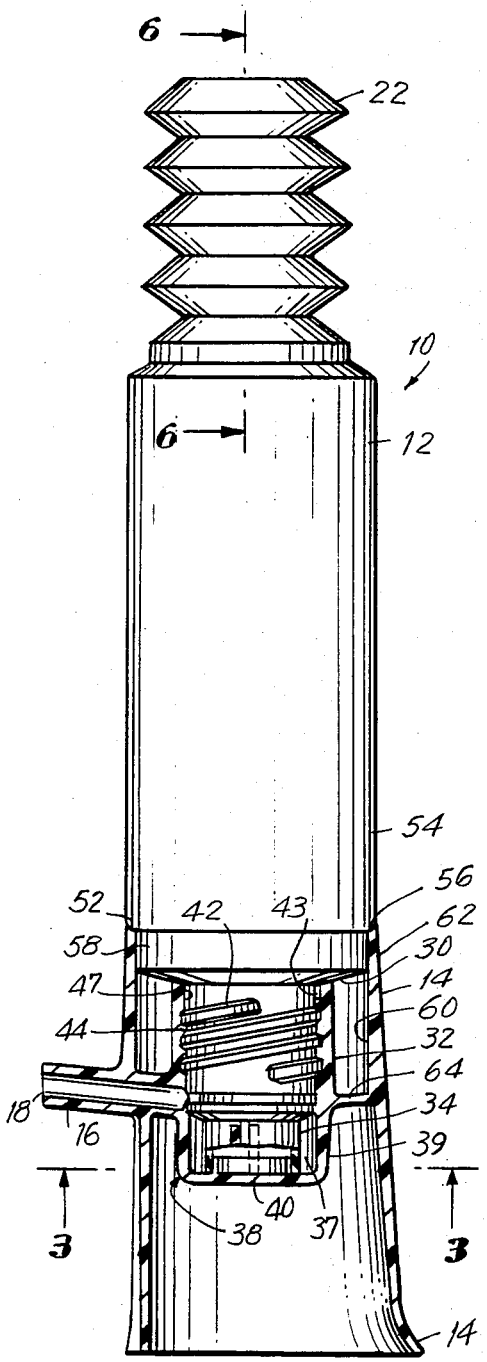
FIG. 2
FIG. 1
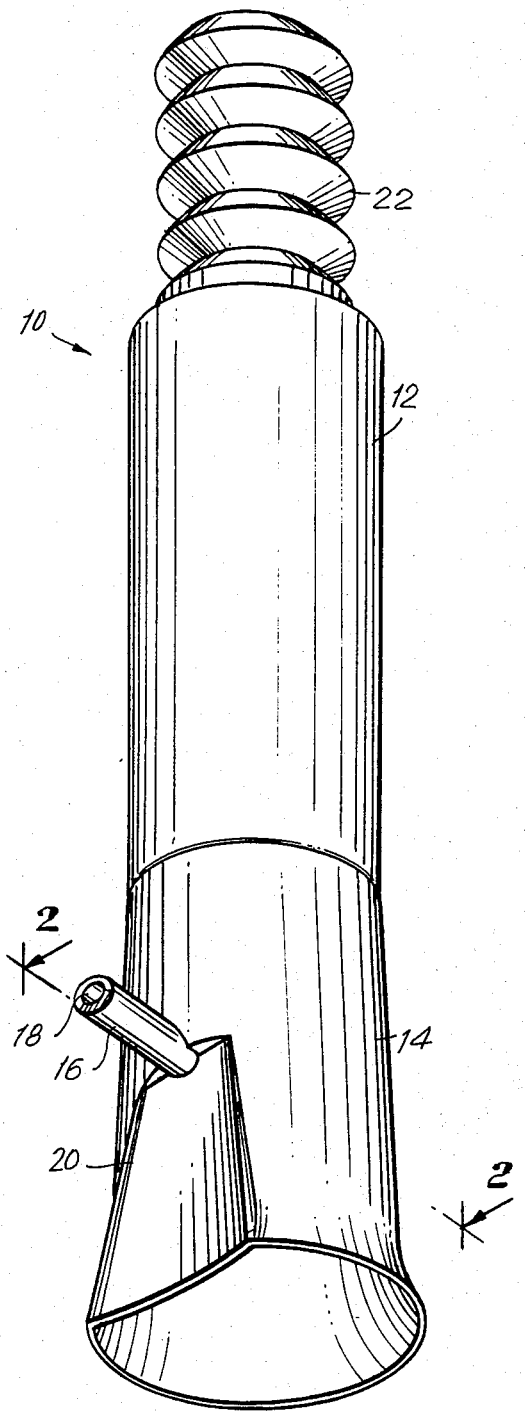

LIQUID PRODUCT DISPENSER

The present invention relates generally to an apparatus for dispensing liquid products, and more particularly to a manually operated dispenser containing a liquid product such as liquid soap, liquid toothpaste, liquid hand cream, and liquid shampoo.

A growing need exists for neatly dispensing an ever-increasing number of liquid products on the market, many of them for use in personal hygiene. Liquid soap, for example, has many advantages over solid hand soap in that it can be disposed of from a container and easily cleaned after use.

Many efforts have been made to create a manually operated dispenser for varying liquid products, but these efforts have resulted in dispensers having a number of failings which have limited the use of everyday liquid products that would be otherwise generally used. These failings include the need to open or close a dispenser container prior to or after usage after the initial opening of the container; the need to pick up the dispenser container to dispense the liquid; the need to turn the dispenser container upside down and to wait for certain viscous products to reach the dispensing orifice; and the need to specially design each dispenser according to the specific viscosity of the liquid product contained therein. These failings are well-known to people associated with the art.

Prior art patents in the general field of dispensing containers are numerous. Patents that have come to my attention, along with references cited of record, are as follows: U.S. Pat. No. 1,910,032 issued May 23, 1933 to Mills discloses a Dispensing Device. U.S. Pat. No. 591,455 issued Apr. 1, 1952 to Marshall describes a Supporting and Content Dispensing Attachment for Collapsable Tubes. References there cited are as follows: U.S. Pat. Nos. 793,259; 1,135,922; 1,382,139; 1,787,060; 1,794,987; 1,862,870; 1,910,032; 1,913,811; 1,917,670; 2,078,149; and 2,084,568. U.S. Pat. No. 3,155,279 issued Apr. 4, 1963 to Ferguson describes a Tooth Paste Dispenser with Tube and Brush Support. References there cited include U.S Pat. Nos. 2,760,681 and 2,771,219. U.S. Pat. No. 3,275,195 issued Sept. 27, 1966 to Reinstra discloses an Integrated Holder and Dispenser. References there cited include U.S. Pat. Nos. 2,179,012 and 2,771,219 and British Pat. No. 862,872. U.S. Pat. No. 3,178,060 issued Apr. 13, 1965 to Bossack describes an Ornamental Cover for Toothpaste Tube. Patents referenced there are U.S. Pat. Nos. 2,535,671; 2,771,219; 2,792,161; 3,100,063; and 3,105,612; Canadian Pat. No. 558,613; and British Pat. No. 287,269. U.S. Pat. No. 3,191,806 issued June 29, 1965 to Schultz et al. discloses a Stand-Up Container. Patents there referenced are U.S. Pat. Nos. 1,129,449; 1,562,005; 1,910,032; 2,016,037; 2,609,122; 2,681,170; 3,010,611; and 3,107,829. U.S. Pat. No. 3,220,611 issued Nov. 30, 1965 to Zander describes a Wall Mounted Bracket and Dispenser for Collapsible Tube. Patents cited there are U.S. Pat. Nos. 1,091,365; 2,216,890; 2,620,943; 2,709,025; 2,772,817; 2,855,127; 2,896,840; and 2,922,380; German Pat. No. 1,017,080; and Swiss Pat. No. 345,439. U.S. Pat. No. 3,221,939 issued Dec. 7, 1965 to Brown discloses Disposable Dispensers. References there noted are U.S. Pat. Nos. 2,134,489; 2,819,792; 2,884,150; 2,958,169; 3,001,673; 3,041,801; and 3,059,766; and British Pat. No. 677,592. U.S. Pat. No. 3,231,139 issued Jan. 25, 1966 to Bouet discloses Dispensing Containers. References cited there are U.S. Pat. Nos. 993,579; 1,207,870; 1,368,349; 1,468,152; 1,656,478; 1,669,001; and 2,449,395; and French Pat. No. 1,219,877. U.S. Pat. No. 3,281,016 issued Oct. 25, 1966 to Thompson discloses a Tube Squeeze Dispenser. References there cited include U.S. Pat. Nos. 2,291,282 and 2,684,066. U.S. Pat. No. 3,405,843 issued Oct. 15, 1968 to Watson discloses a Container-Dispenser for Collapsible Tubes. Patents cited there include U.S. Pat. Nos. 352,343; 1,408,356; 1,537,010; 1,581,412; 2,620,943; 3,061,202; 3,158,176; 3,160,329; 3,220,611; and 3,310,830; Austrian Pat. No. 162,090; French Pat. No. 1,098,204; British Pat. No. 213,337; and Netherlands Pat. No. 67,227. U.S. Pat. No. 3,692,213 issued Sept. 19, 1972 to Alta describes a Container of the Throw-Away Type Provided with a Draining Device. Patents referenced there are U.S. Pat. Nos. 1,844,557; 2,292,604; and 2,554,570. U.S. Pat. No. 3,817,426 issued June 16, 1972 to Fooks describes a Tube Holder. References cited there are U.S. Pat. Nos. 1,590,636; 1,892,140; 1,933,192; 2,084,568; 2,393,103; 2,621,971; 3,133,310; and 3,221,939; and French Pat. No. 980,094. U.S. Pat. No. 3,837,533 issued Sept. 24, 1974 to Splan discloses a Fluid Substance Dispenser. References noted there are U.S. Pat. No. 2,772,817; 2,904,225; 3,112,047; 3,243,084; 3,592,365; and 3,656,660. U.S. Pat. No. 3,868,036 issued Feb. 25, 1975 to Wittwee describes a Safety Package for Collapsible Tubes. The reference cited there is U.S. Pat. No. 3,269,604. U.S. Pat. No. 4,098,434 issued July 4, 1978 to Uhlig discloses a Fluid Product Dispenser. References cited there include U.S. Pat. Nos. 1,752,085; 2,312,067; and 3,618,829; Belgian Pat. No. 528,894; and French Pat. No. 1,255.159.

The present invention contemplates the elimination of all of the above noted limitations and disadvantages of the prior art by providing a novel inexpensive apparatus which has a novel mechanism that can be used during shipment or travel and that can be adapted for use in the household and in addition can be used for liquid products of a wide range of viscosities.

Accordingly, it is an object of my invention to provide a novel means for dispensing liquid products that can be used by manual operation without the need to close the container after it has been opened.

It is a further object of this invention to provide a liquid dispensing apparatus that can be operated without having to lift the dispenser.

It is yet another object of this invention to provide a liquid container for highly viscous liquid products that can be dispensed immediately without having to turn the container upside down and wait for the liquid product to descend to the dispensing orifice.

It is still another object of my invention to provide a dispensing apparatus that is inexpensive to produce and assemble.

It is a further object of my invention to provide a dispensing apparatus that is always ready to dispense the liquid product.

It is another object of this invention to provide an apparatus that can be stabilized for use upon a surface.

It is a further object of my invention to provide a liquid product dispenser that is aesthetic and adaptable to a wide range of aesthetic and usage designs.

It is a further object of my invention to provide a dispenser that can be made safe for traveling by a simple manual operation that places the dispenser in a closed mode.

It is another object of my invention to provide a dispenser that can be opened to a dispensing mode by a simple manual operation.

It is yet another object of my invention to provide a dispensing apparatus that has a container that can be rotated into or from a cylinder chamber thus placing the apparatus in either a closed or a dispensing mode.

It is yet a further object of my invention to provide a unique apparatus that has a flexible and resilient container that when manually squeezed ejects a quantity of liquid product from the dispensing orifice; and that when manually released from being squeezed returns to its original shape, thus causing a pressure imbalance between atmospheric air and the air pocket in the container thus causing the liquid product at the dispensing orifice to be pressed, or sucked, back into the apparatus.

The present invention fulfills the above objects and overcomes the limitations and disadvantages of prior art by providing a hand dispenser for a liquid product that includes a closed container mounted on a base, the container containing a liquid product, and passage means for discharging the liquid product in the container to the atmosphere from a discharge port from the container to a dispensing orifice at the other end of the passage means, the dispensing orifice being positioned outside of said dispenser. Included are a means for manually ejecting a portion of the liquid product from the container to the passage means and to the atmosphere; and means for lowering the liquid product level in the container and creating a lower pressure in the container above the liquid product level than exists in the atmosphere after the ejection of the portion of the liquid. Thus, when the portion of the liquid product is ejected from the dispenser, atmospheric pressure prevents the remaining liquid in the container and in the passage means from passing to the atmosphere.

According to the present invention, there is further provided a container that is movable between a first lowered position and a second raised position, wherein the discharge port is closed in the first position and open in the second position.

Also provided is a cylinder mounted to the base. The cylinder forms a closed chamber having an open side disposed beneath and forming a liquid passage with the discharge port. The cylinder is capable of receiving the bottom portion of the container. Also included are thread means formed by the chamber and the container for allowing rotation and raising and lowering of the container in said chamber between the first and second positions. The thread means form a substantially sealed interconnection between the cylinder and the container.

The means for ejecting a portion of the liquid product include the side wall of the container being made of flexible material, so that when hand pressure is exerted against the side wall of the container, a portion of the liquid product passes from the container into the chamber of the cylinder and through the dispensing orifice.

Also provided is, wherein the means for lowering the liquid level and creating a lower pressure above the liquid level, includes the flexible side wall material also being resilient and self-biased. Thus, when the hand pressure is released, the resilient wall of the container returns to its original position, and the liquid level falls in the container and a lower pressure above the liquid level in the container is created.

As an alternative to the flexible, resilient container, is a flexible, resilient bellows positioned over the container.

My invention will more clearly be understood from the following description of a specific embodiment of the invention, together with the accompanying drawings, wherein similar reference characters denote similar elements throughout the drawings, and in which:

FIG. 1 is a perspective view of the present invention taken from below.

FIG. 2 is an elevational sectional view taken along line 2—2 in FIG. 1.

Figure 6:
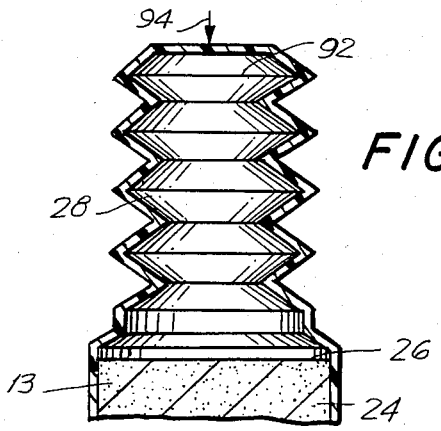
FIG. 6 is a fragmentary side view of the optional bellows of the liquid container taken along line 6—6 of FIG. 2.

Reference is now made in more detail to the drawings.

FIG. 1 illustrates in a perspective view taken from below the dispenser apparatus 10 according to this invention. Also shown are liquid product container 12 supported by base 14, which ordinarily would set upon a flat surface such as a kitchen counter, wash basin, or table (not shown). Spout 16 having dispensing orifice 18 extends from the base area beyond apparatus 10 over a base cutaway 20, which makes access to orifice 18 easier. Optional container flexible bellows 22, which is discussed below in detail, is disposed over container 12 and is in fact a part of container 12. Container 12 includes containing volume 13 and is substantially cylindrical in configuration, except for bellows 22, as illustrated, but can assume other configurations.

FIG. 2 illustrates dispenser apparatus 10 in one of its two positions, here in its first, or closed, position. Liquid produce 24 is stored in container 12 and is sealed in the container, as will be explained, during shipment from the factory or warehouse or during a trip by the user. Before use, the dispenser is set upright on its base as shown in FIG. 2. Liquid 24 will drop and usually, although not necessarily, form a liquid level designated as 26 in FIG. 6 above which is formed an air pocket 28 contained by sealed container 12. The air pocket formed may be the same as the pressure of atmospheric air or may be slightly less. Liquid 24 presses downward exerting pressure at bottom portion 30 of container 12 and beyond through cylindrical neck 32, which is positioned directly below the container, and finally through cylindrical duct 34 located directly below neck 32 to bottom wall 36 of cylinder chamber 37 of cylinder 38, which in turn is situated directly beneath duct 34. Container 12, neck 32, and duct 34 are all connected so that liquid 24 passes freely between them. Liquid product 24 can be of any viscosity, ranging from a thin, freely moving liquid such as a water-based product to thick, slowly moving liquid products of high viscosity. In the preferred embodiment as shown in the illustration, container 12, neck 32, and duct 34 are all cylindrical in configuration and are all substantially centered so that they have a common vertical axis. This embodiment, however, is not a necessary one for the operation of the apparatus and adjustments may be made in the details of the cylindrical configurations within the scope of the invention.

Figure 4:
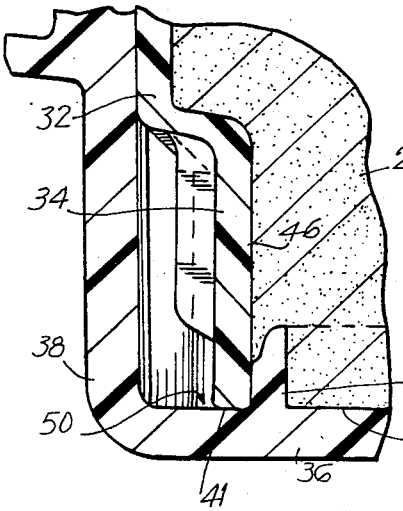
FIG. 4 is a fragmentary elevational sectional view taken along line 4—4 in FIG. 3.

Duct 34 terminates at container discharge port 40 on the down side of cylinder 38. In FIG. 2 port 40 is hard pressed against bottom wall 36 of chamber 37 formed by cylinder 38, the pressing being by reason of container 12 having been lowered by manual clockwise rotation of the container (clockwise as illustrated, but counterclockwise being possible, of course) so as to cause container threads 42 formed on the outer surface 43 of neck 32 and which mate with cylinder threads 44 formed on the outer surface 46 of cylinder 38 to draw the container downwards. As can be seen in FIG. 4, bottom wall 36 of cylinder 38 and duct extension 34 of neck 32 combine to form a container valve, generally characterized as 50. Thus, liquid product 24 contained in container 12 in its lowered, or first, position is not allowed passage from the main portion of the container nor its appendages, neck 32 and duct 34. With the container in this position, it is possible to transport or carry dispenser 10 without loss of the liquid product.

As shown in FIG. 2, container 12 is supported in an upright position by base 14. This support is achieved in part at shoulder 52 of the container, which extends around the lower periphery of the container where container wall 54 meets upper peripheral edge 56 of the base just above container skirt 58, which has a slightly smaller cross-sectional area than the container. In addition, upper inner surface 60 of the base flares inward to provide a wedge support for the container at skirt outer surface 62, which also holds the container in a substantially upright position, besides providing bearing support, since the skirt inner surface 62 and the inner surface 60 do not only distribute vertical bearing support equally around their surfaces. They in addition provide the lateral support needed to keep the container generally upright. FIG. 2 also shows lateral and horizontal support between inner surface 47 of cylinder chamber 37 at the cylinder side wall 39 via cylinder threads 44 and the threads 42 of the neck 32 of the container. That is, not only vertical forces are equalized there but any lateral forces are likewise equalized, thus keeping the container upright. It is noted that the edge of discharge port 40 vertically meets bottom wall 36 of the cylinder, so certain vertical forces are equalized, but, as will be seen, this bearing position is not necessary. Cylinder 38 itself is kept stabilized by a peripheral horizontal support web 64 which is connected to the outer surface 66 of cylinder 38 and to the inner surface 56 of the base, thus connecting the cylinder and the base in stable relationship. Web 64 is interrupted at one point by spout 16 as illustrated in the preferred embodiment.

Figure 5:
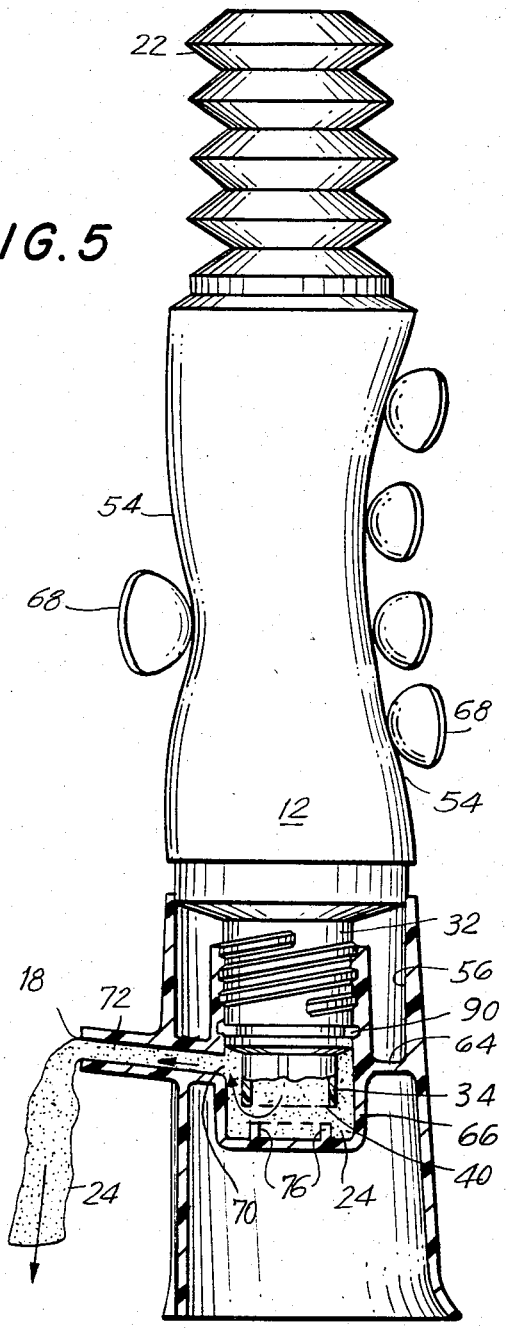
FIG. 5 is a partial fragmentary elevational view of the liquid being dispensed during a dispensing operation.

Manual counterclockwise rotation of container 12 will cause container threads 42 to lever against cylinder threads 44 to raise the container within cylinder 38 to its open, or second, position. In the second position, liquid product 24 is allowed to pass cylinder valve 50, which has been opened by reason of discharge port 40 being raised from bottom wall 36. The open position of dispenser apparatus 10 is illustrated in FIG. 5. Liquid product 24 is shown flowing from duct 34 through port 40 into the lower portion of cylinder 38. FIG. 5 illustrates the situation where the flexible and resilient side wall 54 of the container are being manually squeezed by fingers 68 of the user. In the situation where the container is not being squeezed but is in its second position and ready for use, liquid 24 would not pass from spout 16 but would be held in the general confines of the lower portion of cylinder 38. The air pocket 28 shown in FIG. 6 would, upon opening of valve 50, expand somewhat as liquid level 26 dropped. In such a case, where atmospheric air has no access to air pocket 28 as illustrated and described, a slightly lesser pressure would be created in air pocket 28 relative to the atmospheric air; as a result, the atmospheric air will press downwards on the liquid in the cylinder, forcing the liquid to remain stable within the cylinder where the pressures of atmospheric air and pocket air are equalized.

In FIG. 5 as illustrated, when the user has pressed or squeezed the side wall 54 of resilient container 12, liquid 24 is forced through duct 34, port 40, and the bottom portion of cylinder chamber 37 to the first orifice 70 of spout 16, through channel 72 of the spout and finally through dispensing orifice 18. Upon release of the pressure against the side wall 54 of the container by the user, the container, being made of a resilient, flexible material that is self-biased to its original shape, will assume the configuration as shown in FIGS. 1 and 2. When this occurs, the liquid level 26, which is shown by way of example in FIG. 6 along with air pocket 28 above the liquid level in volume 13 of container 12, will fall to a new, lower liquid level. Air pocket 28 simultaneously will be enlarged and so, because the quantity of air in the pocket remains the same, the pressure in the pocket will drop to that below atmospheric pressure. The pressure of the outside air will then exert pressure at dispensing orifice 18 and then, as liquid product 24 is forced back by atmospheric air pressure, the air pressure is exerted in chamber 37. In the meantime, liquid level 26 will fluctuate until the pressure in pocket 28 becomes equal to atmospheric pressure and liquid level 26 stabilizes.

Thus, when container 12 is in the raised position, liquid product 24 is free to pass through discharge port 40 to passage means including cylinder chamber 37 and spout channel 72 to dispensing orifice 18. Means for manually ejecting a portion of liquid 24 from container 12 into the passage means and to the atmosphere includes in the preferred embodiment container side wall 54 being made of a flexible material. Means for lowering liquid level 26 in container 12 and for creating a lower pressure in volume 13 of the container in air pocket 28 over the liquid level after the ejection of the portion of liquid product 24 includes in the preferred embodiment the container side wall 54, in addition to being made of flexible material, being made of material that is in addition resilient and self-biased so that the side wall of the container returns to its original position, thus causing the liquid level in the container to fall, thus creating a lower pressure above the liquid level in the container. This in turn causes atmospheric air to press back liquid in spout 16 until the pocket pressure and atmospheric pressure are substantially equal, except for allowance of head pressure caused by the column of liquid product above discharge port 40.

Discharge port 40 includes peripheral edge 41 disposed at the bottom portion of neck member 32, specifically at the duct extension 34 of neck 32. It is noted that neck 32 is smaller in cross-sectional area than that of container 12 and that duct 34 is smaller in cross-sectional area than neck 32. Preferably neck 32 and duct 34 are circular in cross-section as is the configuration of discharge port 40, the peripheral edge 41 of which is identical to the outlet of duct 34. Edge 41 is in substantially sealed alignment with bottom wall 36 of cylinder chamber 37 when container 12 is in the first closed position and is removed from the bottom wall when the container is in the second open position.

Figure 3:
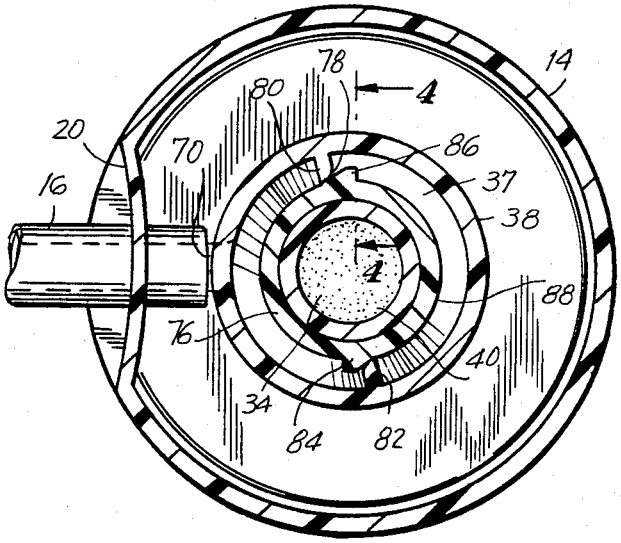
FIG. 3 is a bottom sectional view taken along line 3—3 in FIG. 2.

As shown in FIGS. 2, 3, 5 and particularly in FIG. 4, a raised circular ring portion 76 is connected to bottom wall 36 of cylinder chamber 37. Ring portion 76 is capable of being in sealing alignment with the inner surface 46 of neck member 32, specifically the inner surface 46 of neck duct extension 34, when container 12 is in its first sealed position. Discharge port 40 is thus substantially sealed from the passage of liquid product 24 in the first position of the container. Thus, the novel invention allows easy factory packing, shipment to and from warehouses, and placement in the user's luggage with one simple twist of container 12.

Dispenser 10 further includes stop means 78 for checking the upward movement of container 12 when the container has reached its second position during manual rotation of the container. The stop means include at least one and preferably two vertical first projecting members 80, 82 extending from inner surface 46 of cylinder chamber 37 below cylinder threads 44 and at least one and preferably two vertical second projecting members 84, 86 extending from outer surface 88 of duct 34. Projecting members 80 and 82 are disposed diametrically opposed to one another as are projecting members 84 and 86. Members 80 and 82 and 84 and 86 are so disposed that member 80 strikes member 84 and member 82 strikes member 86 when container 12 has been rotated to its second or open position and thereupon check further rotation.

Also included in the invention is a wiping sealing ring member 90 mounted around the outer surface 43 of neck 32 below neck threads 42, as shown in detail in FIG. 3. Sealing ring 90 is in sliding sealing contact with inner surface 46 of cylinder 38. Thus, liquid product 24 is kept from passing from the cylinder chamber upwards into the thread mating area.

Further included as a means for ejecting a portion of liquid product 24 and as a means for lowering liquid level 26 and creating a lower pressure above the liquid level optionally includes a flexible, resilient bellows member 22 positioned above container 12 and including an extension of containing volume 13 and sealingly connected to said container or, as illustrated, unitary with container 12. Bellows 22 forms volume 92 which is an extension of volume 13 of container 12. When bellows 22 is manually pressured downwards at arrow 94 in FIG. 6 while container 12 is in its second open position, liquid product 24 is ejected from dispensing orifice 18, and when the manual pressure is released, bellows 22 resumes its former configuration, thus creating a lowered liquid level and a lowered pressure above the new liquid level in the container. Liquid 24 in spout 16 is back-pressured by atmospheric air, which has a greater pressure than the air in pocket 28 until the pressure in the pocket substantially equals pressure in the pocket in the manner previously described. Bellows 22 can be used in configuration with flexible container 12 or with a rigid container.

Spout 16, which has its first orifice 70 positioned in cylinder chamber 37 slightly above the bottom wall 36 of the chamber, extends at a slight incline upwards to dispensing orifice 18 in order to prevent run over from the chamber and through the spout in such cases where room temperature rises so as to increase the pressure in air pocket 28 relative to atmospheric pressure. In such a case, there can be a tendency for liquid product 24 to be oozed out orifice 18 unless an elevational distance is created to prevent such a result.

Container 12 can have many other designs within the scope of the invention. Although the preferred embodiments show generally cylindrical configurations for the container, the neck and its duct connection and the cylinder chamber, other configurations are possible. In particular, the liquid container can be designed to accomplish its purpose by other designs, including by way of example bellows 22, which, as stated, can be used with a rigid container 12.

The embodiment of the invention particularly disclosed and described hereinabove is presented merely as an example of the invention. Other embodiments, forms and modifications of the invention coming within the proper scope and spirit of the appended claims will, of course, readily suggest themselves to those skilled in the art.

What is claimed is:

1. A hand dispenser for a liquid, in combination, comprising:

a base, a closed container mounted on said base for storing said liquid, said container having a discharge port, said container being vertically movable between a first lowered position and a second raised position, said discharge port being closed in said first position and open in said second position, passage means for discharging said liquid contained in said container to the atmosphere, said passage means being connected to said discharge port at one end and having a dispensing orifice at the other end, said dispensing orifice being positioned outside of said dispenser, means for manually ejecting a portion of said liquid from said container into said passage means and to the atmosphere, means for lowering the liquid level in said container and creating a lower pressure in said container above the liquid level than exists in the atmosphere after the ejection of said portion of said liquid, whereby when the portion of the liquid is ejected from teh dispenser, atmospheric pressure prevents the remaining liquid in the container and in the passage means from passing to the atmosphere, said hand dispenser further including a cylinder mounted to said base, said cylinder forming a closed chamber having an open side disposed beneath and forming a liquid passage with said discharge port, said cylinder being capable of receiving the bottom portion of the container, thread means formed by the chamber and the container for allowing rotation and raising and lowering of the container in said chamber between said first and second positions, the thread means forming a substantially sealed interconnection between said cylinder and said container, a neck member connected to the bottom of said container, said neck member forming a connecting passage between said container and said chamber, said neck member being smaller in cross-sectional area than the bottom of said container, said thread means forming by said container being mounted on said neck member, said discharge port including a peripheral edge disposed at the bottom portion of said neck member, said cylinder including a bottom wall, said peripheral edge being in substantially sealed alignment with said bottom wall when said container is in said first position, and being removed from said bottom wall when said container is in said second position, a raised ring portion connected to said bottom wall of said cylinder, said raised ring portion being capable of being in sealing alignment with the inner surface of said neck when said container is in said first position, whereby said discharge port is sealed around the periphery of the port in the first position, a duct extension member disposed at the bottom of said neck member, said discharge port being positioned at the bottom of said duct member, said duct member having a smaller cross-sectional area than said container, said discharge port being disposed at the bottom of said duct member, said discharge port being formed by edge portions of the bottom of said duct member, and a discharge spout connected to said cylinder chamber and extending through said base, said spout including said dispensing orifice and an opposed inner orifice positioned in the side wall of said chamber and spaced above the bottom wall of said chamber.

2. A hand dispenser according to claim 1, further including stop means for checking the upward movement of said container when said container has reached said second position, said stop means including at least one vertical first projecting member extending from the inner wall of said cylinder below said cylinder threads, and at least one vertical second projecting member extending from the outer wall of said duct member, said projecting members being positioned to meet when said container has been rotated to said second position and thus check further rotation.

3. A hand dispenser according to claim 1, further including a wiping sealing ring member mounted around an outer surface of said neck below said neck threads, said ring member being in sliding sealing contact with said inner surface of said cylinder chamber, whereby liquid is kept from escaping from said cylinder chamber.

4. A hand dispenser according to claim 1, wherein said base has a circumferential wall disposed around said cylinder and further including a horizontal support web disposed around the periphery of said cylinder, said web being connected to the outer surface of said cylinder and to the inner surface of said wall of said base.

5. A hand dispenser according to claim 1, wherein said means for manually ejecting a portion of said liquid and said means for lowering the liquid level and creating a lower pressure above the liquid level includes a flexible, resilient bellows member positioned above said container and sealingly connected to said container, said bellows forming a hollow portion forming a part of said container, whereby when said bellows is manually pressured downwards when said container is in said second position, liquid is ejected from said dispensing orifice, and when said manual pressure is released, the bellows resumes its former configuration, thus creating a lowered liquid level and a lowered pressure above the liquid level in the container.

6. A hand dispenser according to claim 1, wherein said dispensing orifice is disposed at a higher elevation than said inner orifice.

7. A hand dispenser according to claim 1, wherein said means for manually ejecting a portion of said liquid include a container side wall being made of a flexible material, whereby when hand pressure is exerted against the side wall of the container, when said container is in said second position, a portion of liquid passes from the container into said chamber of said cylinder and through said dispensing orifice.

8. A hand dispenser according to claim 7, wherein said means for lowering the liquid level and creating a lower pressure above the liquid level includes said flexible material being also resilient wherein said container side wall is self-biased, whereby when the hand pressure is released, the resilient side wall of the container returns to its original position, thus causing the liquid level in the container to fall, thus creating a lower pressure above the liquid level in the container.

* * * * *